United States Patent [19]

Manguso

[11] 3,997,937

[45] Dec. 21, 1976

[54] CARPET TACK STRIP ANCHORING MEANS AND INSTALLATION TOOL

[76] Inventor: Michael F. Manguso, 3743 E. Coronado, Phoenix, Ariz. 85008

[22] Filed: Aug. 7, 1975

[21] Appl. No.: 602,664

[52] U.S. Cl. ..... 16/6; 16/16; 145/46

[51] Int. Cl.[2] ..... A47G 27/04

[58] Field of Search ..... 16/16, 4, 5, 6, 7, 8; 248/300, 317; 145/46; 24/85 R

[56] References Cited

UNITED STATES PATENTS

| | | | |
|---|---|---|---|
| 2,563,615 | 8/1951 | Paul | 16/16 |
| 2,631,809 | 3/1953 | Jacobson | 248/317 |
| 2,670,494 | 3/1954 | Owens | 16/16 |
| 2,681,164 | 6/1954 | Kalfen | 248/300 X |
| 3,805,862 | 4/1974 | Jirovetz | 16/4 X |
| D162,122 | 2/1951 | Broeren | 248/300 X |

FOREIGN PATENTS OR APPLICATIONS

| | | | |
|---|---|---|---|
| 1,136,230 | 12/1968 | United Kingdom | 16/16 |

*Primary Examiner*—Andrew V. Kundrat

[57] ABSTRACT

The disclosure relates to a carpet tack strip anchoring means and installation tool and particularly for use in anchoring tack strips relative to wall structures in areas where it is virtually impossible to anchor tack strips to concrete floors due to the fact that in some instances concrete becomes so hard that it is very difficult to nail the tack strips to the concrete in such a manner that the nails penetrate properly without cracking the concrete away. The anchoring means comprising a clip having a normally horizontal portion adapted to rest adjacent to building room floor the horizontal portion having opposite ends provided with respective upstanding portions integral therewith; one of the upstanding portions is provided with an opening through which a nail is projected and this upstanding portion has an integral clip portion disposed in spaced relation from the bottom portion and extending substantially horizontally toward the opposite end of the bottom portion. The said opposite end of the bottom portion has an upstanding portion which has sufficient length to be folded over a tack strip and to thereby form a retaining clip portion which is horizontally disposed over the upper portion of the tack strip.

7 Claims, 5 Drawing Figures

FIG. 1.
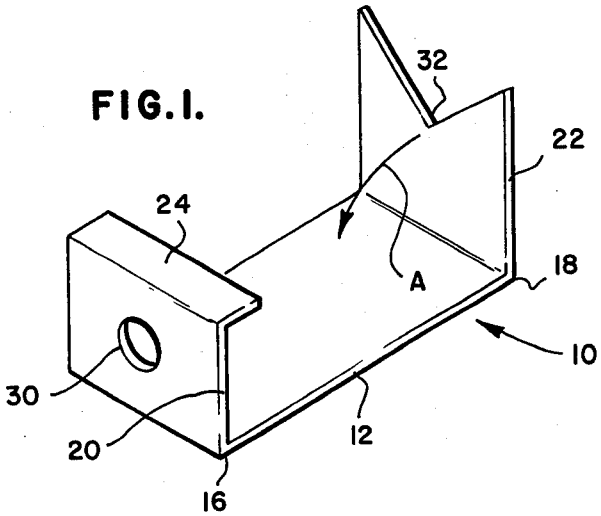
FIG. 3.
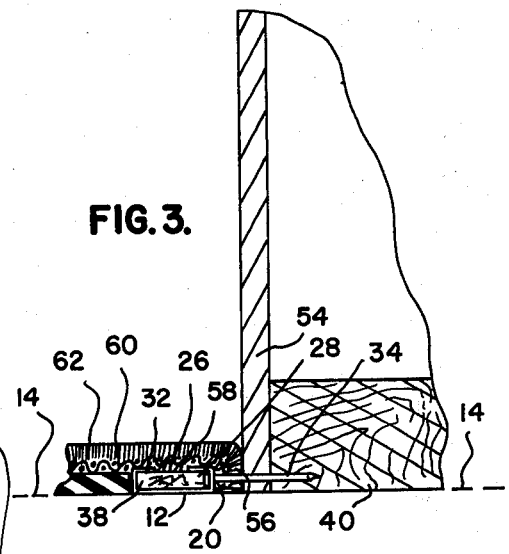
FIG. 2.
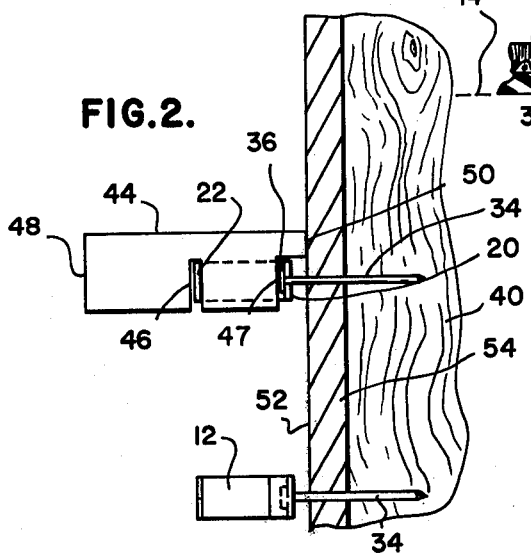
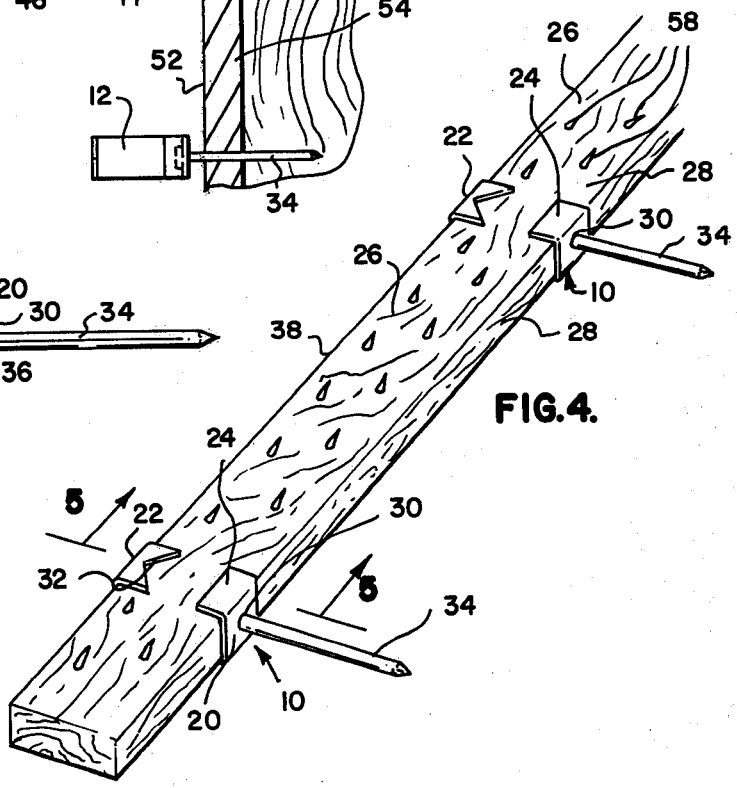
FIG. 4.
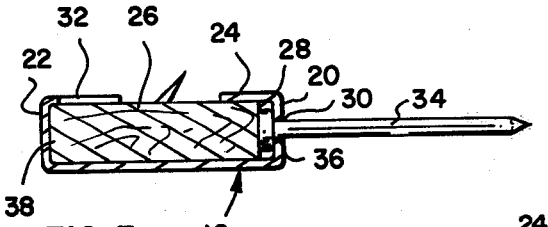
FIG. 5.

CARPET TACK STRIP ANCHORING MEANS AND INSTALLATION TOOL

BACKGROUND OF THE INVENTION

In many areas building structures have concrete floors and many of these floors are so hard that the driving of a conventional concrete penetrating nail into such floors is virtually impossible due to the hardness of the concrete and the relative cracking thereof which prevents carpet holding or anchoring tack strips from being installed by the usual method of nailing them down to the concrete floor. The foregoing difficulties which are particularly encountered in relation to concrete floors which are old and which have become so hard that the concrete is relatively brittle and such conditions have caused a great deal of difficulty in anchoring carpet tack strips adjacent to walls and have cost considerable loss in time during the installation of carpeting in the various building rooms over concrete floors.

PRIOR ART U.S. Pat. Nos. 451,043, 1,416,051, 2,563,615, 2,670,494, 3,308,862, Australian Patent 110,463, British Patent 1,136,230.

SUMMARY OF THE INVENTION

The present invention comprises a very economical and compact carpet tack strip anchoring means which utilizes a minimum amount of metal and which is very compact and capable of being either installed initially on a carpet anchoring tack strip as this strip is manufactured or the anchoring means of the invention and particularly the clip portion may be installed at the time that the carpet is laid in a building room and the specific structure of the anchoring means includes a clip having two upstanding portions with foldable portions adapted to be folded over the upper surface of a tack strip in opposed relation to each other and one of the upstanding portions is provided with an opening through which a nail is projected and the head of the nail is adjacent to the inside of the upstanding portion and between said upstanding portion and an edge of the tack strip such that the nail may be driven by driving the clip and the tack strip with a hammer when the clip and nail are installed on the tack strip initially. The simple mechanism of the clip alone when installed preliminary to installation of the tack strip is such that an opening extending through the one upstanding portion of the clip may be driven by a simple tool having a spacer stop means adapted to stop the penetration of the nail into a wall structure at a distance wherein the tack strip and holding clips when installed are spaced from the wall a sufficient distance to allow the edge of a carpet to be tucked between the wall and the tack strip. The basic clip structure of the invention used for installation on the tack strip at the time that the carpet is laid is a very simple clip having a pair of upstanding portions integral with opposite ends of a bottom portion which is adapted to lie horizontally on a floor. Each upstanding portion is provided with a clip portion; the one upstanding portion having a clip portion extending horizontally in spaced relation from the bottom portion and this particular upstanding potion having an opening through which a nail may be projected. The other upstanding portion being initially disposed at right angles to the bottom portion and having a notch therein, adapted to provide for clearance of the head of a nail when inserted through the opening in the first mentioned upstanding portion; the upstanding portion having the notch therein, being capable of being folded over the pounded down onto the top of a tack strip after one edge of the tack strip has been inserted into the clip adjacent to a nail extending through said opening whereby the clips may be installed in relation to a wall structure wherein the usual dry wall studding or other combination of structures exist and wherein the usual wooden floor plate is disposed on the top of the floor such that the aforementioned nail extending through the upstanding portion of the clip may penetrate either the wooden floor plate or may be driven between the floor plate and the concrete floor so as to hold a tack strip in adjacent relationship to a wall structure and the tack strip referred to is the usual and conventional one having angularly upstanding tacks adapted to impale themselves in the fabric backing of a carpet which is initially stretched from one side of a room to the other the pressed down on the tacks for holding the carpet in tension between walls and for holding it in place adjacent to the respective wall areas of a room.

The invention comprises an installation tool, having a slided side adapted to receive the aforementioned notched upstanding portion of the tack strip. The tool also having a driving portion adapted to extend between the upstanding portions and engage the head of a nail adjacent to the aforementioned opening through which the nail extends; the tool also having an offset portion extending beyond the area of the driving portion so as to engage a wall structure and stop the penetration of the nail at a spaced relationship to the wall surface so that the clip as well as a connected tack strip is spaced from the surface of the wall a sufficient distance to allow the edge of a carpet to be tucked between the wall and the tack strip after installation in connection with the usual tack strip.

Accordingly, it is an object of the present invention to provide a very simple and economical carpet tack strip anchoring means employing a minimum amount of metal and which is very simple and economical in construction and installation and which either may be installed on tack strips initially at the manufacturer's option or may be installed by the tradesman laying carpet.

Another object of the invention is to provide a carpet tack strip anchoring means employing a clip which may be clipped onto a tack strip with a nail extending from the clip and which allows the head of the nail, adjacent to the side of the tack strip, to be driven into a wall simply by drving with a hammer or other instrument the clip and tack strip which in turn drives the nail into the wall.

Another object of the invention is to provide a very simple clip means and tool for installing the same which is particularly adapted for precision installation of tack strips in certain spaced relations from wall structues and which allows the tack strip to be anchored to a wooden floor plate or adjacent thereto without the necessity of driving nails into the concrete floors.

Further objects and advantages of the invention may be apparent from the following specification, appended claims and accompanying drawings.

BRIEF DESCRIPTION OF THE DRAWINGS

FIG. 1 is a perspective view of a clip forming part of a carpet tack strip anchoring means of the present invention;

FIG. 2 is a planned view of the clip shown in FIG. 1 with a driving tool engaged therewith and showing the tool in position wherein a nail in connection with the clip is driven into a wall structure and into a floor plate structure thereof; FIG. 2 also showing a tack strip anchoring clip of the invention and a respective nail previously installed by said tool;

FIG. 3 is a vertical sectional view of a wall structure with a tack strip and the carpet tack strip anchoring means of the invention adjacent to the floor of the room and secured to the wall stretcher and further showing a carpet pad and a carpet installed relative to a conventional tack strip with the edge of the carpet tucked between the tack strip and the wall structure;

FIG. 4 is a perspective view of a carpet tack trip anchoring means of the invention secured to conventional tack strip as may be installed by a manufacturer on a tack strip before delivery to the tradesman; and FIG. 5 is a sectional view taken from the line 5 — 5 of FIG. 4.

DESCRIPTION OF THE PREFERRED EMBODIMENTS

The carpet tack strip anchoring means of the present invention, as shown in FIG. 1 is provided with a clip designated 10. This clip 10 is provided with a bottom portion 12 which is generally disposed horizontally as shown in FIG. 3 an insubstantially contiguous relation with a floor as shown by broken lines 14 in FIG. 3.

The bottom portion 12 of the clip 10 is provided with first and second ends 16 and 18 integral with which are first and second upstanding portions 20 and 22 respectively; these portions being substantially vertical. The upstanding portion 20 having a generally horizontal clip portion 24 extending toward the upstanding portion 22 and adapted to overide the upper surface of a tack strip 26 at an edge 28 thereof, such as shown in FIGS. 3 and 4 of the drawings. The upstanding portion 20 is provided with a nail receiving opening 30 extending therethrough and as will be hereinafter described, said nail is adapted to secure the clip 10 in adjacent relationship with a floor and wall of a building room structure.

The upstanding portion 22, as shown in FIG. 1, is initially generally vertical and is provided with a notch 32 adapted to provide for clearance of a nail and nail head as it may be inserted into and through the opening 30 in the direction of an arrow A in FIG. 1 of the drawings.

As shown in FIGS. 4 and 5 of the drawings, the clip 10 together with a nail 34 may be installed on conventional wooden tack strip 26 when the tack strip is produced and thus the tack strip 26 may be equipped with the clips 10 having the nails 34 projected laterally of the respective edge 28 of the tack strip. As shown in FIG. 5 of the drawings, the nail 34 is provided with a head 36 abutted to an inner side of the upstanding portion 20 of the clip 10 and the clip portion 24 overlies the upper portion of the tack strip adjacent to its edge 28 which is abutted to the head 36 of the nail 34. The upstanding portion 22 is folded over the upper surface of the tack strip adjacent to an edge 38 which is opposite to the edge 28, hereinbefore described. The notch portion 32 of the upstanding portion 21 is folded into a horizontal position over the upper surface of the tack strip 26, all as shown best in FIG. 5 of the drawings. With the assembly of the clip 10 and the nails 34, as shown in FIGS. 4 and 5 of the drawings, the tradesman may pound on the upstanding portion 22 of each clip 10 and this will cause compression driving of the head 36 of the nail 34 so as to drive the nail 34 into a floor plate designated 40 and as shown in FIGS. 2 and 3 of the drawings.

When the tradesman is installing the clip as shown in FIG. 1 of the drawings, the clip is disposed adjacent to the floor 14 and the bottom portion 12 of the clip is laid on the floor with the nail 34 extending through the opening 30 as herebefore described. A driving tool 44 is provided with a notch portion 46 which receives the upstanding portion 22 in its straight condition as shown in FIG. 1. A driving portion 46 of the tool engages the head 36 of a nail 34 and an end 48 of the tool is pounded upon by a hammer until a stop portion 50 of the tool engages the surface 52 of a wall structure 54. The portion 50 of the tool 48 is spaced from the driving end 46 such as to space the upstanding portion 20 of the clip 10 from the wall a sufficient distance to allow for carpeting to be folded between the wall structure 54 and the upstanding portion 20. The fold of the carpet being designated 56 in a location where it is folded between the wall 54 and the tax strip edge 28. This operation of placing the edge 56 of the carpet in such location is known as tucking the edge of the carpet in between the wall and the tack strip. The conventional tack strip is provided with angular disposed tacks 58, which are well known to those skilled in the art, in which become impaled upon the backing 60 of the carpet 62, shown in FIG. 3 of the drawings.

It will be obvious to those skilled in the art that the clip 12 together with a tack strip 26 may be installed in two different ways; first of all by providing the entire assembly, as shown in FIGS. 4 and 5 of the drawings, such as a manufactured item, which may be received from the manufacturer by the tradesman and the other mode of installation is as shown in FIGS. 1, 2 and 3 wherein the clip 10 is first installed with the nails 34 in connection with wall structure, then the tack strip 26 is placed between the upstanding portions 20 and 22 and then the notch portion 32 of each clip 10 is folded over the upper surface of the tack strip adjacent to its respective edge 38 to thereby secure the tack strip 26 between the upstanding portions 20 and 22 and between the bottom 12 and the clip portion 24 and the folded over notched portion 32.

It will be obvious to those skilled in the art that the use of the nail 34 relative to the wall structure illeviates the necessity of driving hard nails through the tack strip 26 and into a hard concrete floor, such as the floor 14.

Further, it will be obvious to those skilled in the art that various modifications may be resorted to without departing from the spirit of the invention.

I claim:

1. A clip having normally horizontal bottom portion; said horizontal bottom portion having opposite ends provided with upstanding portions; said upstanding portions having clip portions extending toward each other in a normally horizontal disposition; one of said upstanding portions having a nail receiving opening therethrough and wherein a carpet holding tack strip is held in the confines of said bottom, extending portions and said clip portions.

2. The invention as defined in claim 1, with a nail extending through said opening; said nail having a head disposed between said one of said upstanding portions and said tack strip.

3. The invention as defined in claim 2, wherein: said nail extends from said upstanding portions; and building wall structure into which said nail is imbedded for holding said tack strip adjacent to said wall structure.

4. The invention as defined in claim 3, wherein: said one upstanding portion of said clip is spaced from said wall structure a distance so as to permit a carpet to be tucked between said tack strip and said wall structure.

5. A carpet tack strip anchoring means comprising a clip having a normally horizontal bottom portion; said clip having first and second ends; said bottom portion having first and second upstanding portions integral with said first and second ends respectively; said first upstanding portion having a nail receiving opening extending therethrough; said first upstanding portion having a clip portion which is spaced from said bottom portion and which extends toward said second upstanding portion; said second upstanding portion being integral with said second end and having a notched portion extending above said clip portion; said notched portion having sufficient normally vertical length so as to be folded over a carpet holding tack strip into a clip portion similar to that of said first upstanding portion.

6. A carpet tack strip anchoring means comprising a clip having a normally horizontal bottom portion; said clip having first and second ends; said bottom portion having first and second upstanding portions integral with said first and second ends respectively; said first upstanding portion having a nail receiving opening extending therethrough; said first upstanding portion having a clip portion which is spaced from said bottom portion and which extends toward said second upstanding portion; said second upstanding portion being integral with said second end and having sufficient normally vertical length so as to be foldable over a carpet holding tack strip into a clip portion similar to that of said first upstanding portion and wherein a driving block is provided with a notch adapted to receive said second upstanding portion; said block having a driving portion extending between said first and second upstanding portions and adapted to engage the head of a nail adjacent to said first upstanding portion.

7. The invention as defined in claim 6, wherein: said block is provided with a stop portion disposed outside the confines of said clip and extending beyond said driving portion of said block; said stop portion being adapted to engage a wall structure and limit the projection of a nail thereinto such that said first upstanding portion of said clip is installed in space relation to said wall structure whereby the edge of a carpet may be tucked between said tack strip and said wall structure.

* * * * *